United States Patent [19]

Philipp

[11] 4,273,324

[45] Jun. 16, 1981

[54] SUCTION BRAKING APPARATUS

[75] Inventor: Helmut Philipp, Eckrath-Unterbach, Fed. Rep. of Germany

[73] Assignee: Jagenberg Werke Aktiengesellschaft, Dusseldorf, Fed. Rep. of Germany

[21] Appl. No.: 63,026

[22] Filed: Aug. 1, 1979

[30] Foreign Application Priority Data

Jul. 31, 1978 [DE] Fed. Rep. of Germany ..... 2833570

[51] Int. Cl.[3] ..... B65H 29/68

[52] U.S. Cl. ..... 271/183; 271/231; 271/299

[58] Field of Search ..... 271/183, 197, 202, 229, 271/231, 171, 270, 299

[56] References Cited

U.S. PATENT DOCUMENTS

| | | | |
|---|---|---|---|
| 2,481,934 | 9/1949 | Langston | 271/183 X |
| 3,659,839 | 5/1972 | Baucke | 271/183 |
| 3,684,277 | 8/1972 | Buschmann | 271/183 |
| 3,972,523 | 8/1976 | Brandes | 271/183 |
| 4,096,941 | 6/1978 | Tokuno | 271/197 |

*Primary Examiner*—Robert W. Saifer

*Attorney, Agent, or Firm*—Sprung, Felfe, Horn, Lynch & Kramer

[57] ABSTRACT

A suction braking apparatus for the braking and overlapping of sheets coming from a duplex crosscutter is provided which has a single suction chamber and can be quickly changed over to accommodate sheets of a different width. The suction chamber is provided with two groups of suction holes arranged in a row in the direction of travel of the sheets and has cover plates perforated in register therewith and each has a perforated control belt. Each group of suction holes has associated therewith a cover slide which is movable at a right angle to the direction of sheet travel with the two cover slides reciprocally covering a group of suction holes, starting from one of the two side edges and up to a junction extending in the direction of sheet travel.

4 Claims, 6 Drawing Figures

SUCTION BRAKING APPARATUS

BACKGROUND OF THE INVENTION

The invention relates to a suction braking apparatus for the braking and overlapping of sheets to be stacked, particularly sheets of paper, which comprises a suction chamber provided with suction holes, a cover plate perforated in register therewith, and at least one perforated control belt movable between cover plate and suction chamber at right angles to the direction of travel of the sheets. A suction braking apparatus of this type has become part of the prior art through German Pat. No. 1,917,616 and German patent of addition No. 2,000,078.

SUMMARY OF THE INVENTION

The object of the present invention is to improve the prior-art suction braking apparatus in such a way that the sheets coming from a duplex crosscutter can be braked and overlapped by means of a suction braking apparatus having but one suction chamber. The suction braking apparatus should preferably be such that a quick changeover can be made at the suction braking apparatus when the sheet size is changed at the duplex crosscutter. The technical problems to be solved arise particularly from the fact that the sheets coming from the crosscutter in different sizes and at high speed must be decelerated with a single suction chamber, and that the uniform suction-chamber space should further be capable of being set for different sheet widths.

These difficulties are overcome in a suction braking apparatus of the type outlined in that the suction chamber is provided with two groups of suction holes, arranged in a row in the direction of travel of the sheets and having cover plates perforated in register therewith and a perforated control belt each, and that a cover slide movable at right angles to the direction of travel is provided for each of the two groups of suction holes, with the two cover slides reciprocally covering a group of suction holes, starting from one of the two side edges and up to a junction extending in the direction of sheet travel.

The two separate control belt are controlled as a function of the sheets coming from the crosscutter so that the associated control belt uncovers the suction holes of the suction chamber or of the cover plate, respectively, whenever the rear portion of a particular sheet passes the area of the associated suction holes. The cover slides associated with each of the two control belts assure that the suction holes disposed in the suction chamber or in the cover plate permit suction to be exerted on the rear portion of the sheet only on the other side of the cover slide, that is to say, past the junction, viewed at right angles to the direction of sheet travel.

In accordance with an advantageous embodiment, there are disposed between the suction chamber provided with suction holes and the cover plates provided with suction holes intermediate plates with suction holes in register therewith. These intermediate plates form a plane between the control belts and the cover slides, with the control belts advantageously extending above the intermediate plates, and the cover slides below the intermediate plate and above the suction chamber. The suction holes may be provided over the entire width of the suction chamber, of the cover plate perforated in register therewith, and optionally of the intermediate plate perforated in register therewith. However, in accordance with a preferred embodiment, only one group of suction holes extends over the entire width of the suction chamber while the other suction-hole group extends over not more than one-half the width of the suction chamber. In the last-mentioned embodiment, the effectiveness of the suction chamber in the area of one of the control belts is limited from the outset to half of the width of the suction chamber, there being absolutely no leakage losses in the portion of the suction chamber not provided with suction holes. Limiting the suction holes to half of the suction-chamber width offers only advantages in actual use since at the duplex crosscutter at least one of the two sheets can occupy not more than half the width of the web. As a rule, however, the sheet size will be set so that one of the sheets is narrower than one-half the suction-chamber width so that the cover slide is effective over the area of the perforated half of the suction-chamber width.

It is advisable that the suction holes of each group extend over a length of from 100 to 200 mm, viewed in the direction of travel, the two groups being preferably spaced from 25 to 75 mm apart. The same spacing in the direction of travel then applies to the separate control belts and the cover slides.

In accordance with a preferred embodiment, the cover slide is a part of a transversely movable belt which, viewed in the direction of the belt, is unperforated on one side of the junction and is provided with suction holes on the other side thereof. A transversely movable belt may be provided for each of the control belts. The belts may be endless belts and may be made to return over joint rollers so that they can be positioned together in the transverse direction by means of said rollers. However, the two belts may also be combined into a single belt. Both designs offer the advantage that in a changeover to another sheet width, through rotation of the rollers, the common junction is automatically maintained. In practice the common junction is displaced transversely only for adjustment to a new sheet width.

The special advantages of the suction braking apparatus in accordance with the invention reside in the fact that two sheets of different sizes cut simultaneously from a wide web can be braked with one suction-chamber space to secure overlapping. The suction braking apparatus permits quick changeover to another sheet width in the transverse direction since the construction and position of the suction chamber, of the cover plate and of the control belts remain unchanged and only the cover slide must be displaced in the transverse direction to change the location of the junction. This can be done very quickly as the changeover is being made at the duplex crosscutter. When the cover slide is fully closed in the area of one of the two suction belts, it becomes possible, moreover, to use the suction braking apparatus also with a simplex crosscutter.

BRIEF DESCRIPTION OF THE DRAWING

The invention will now be explained in greater detail with reference to the drawing illustrating an embodiment, wherein.

DETAILED DESCRIPTION OF THE INVENTION

Figure 1:
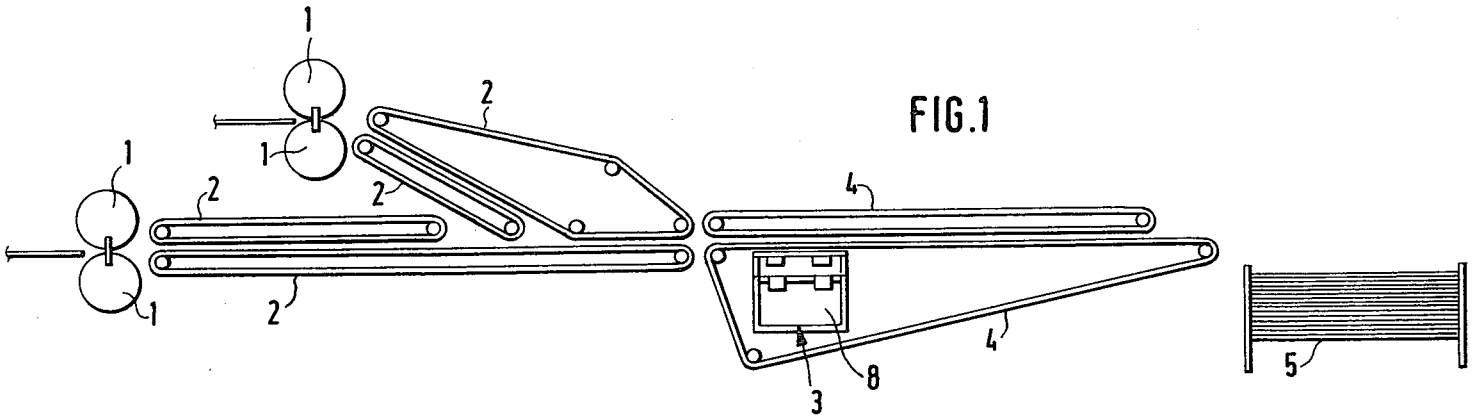
FIG. 1 is a diagrammatic side elevation of the overall installation.

As shown in FIG. 1, the sheets produced by a duplex crosscutter 1 are carried by conveyor belts 2 into the area of the suction braking apparatus, generally designated 3, and after being braked and overlapped are carried by the conveyor belts 4 to the stack 5.

Figure 2:
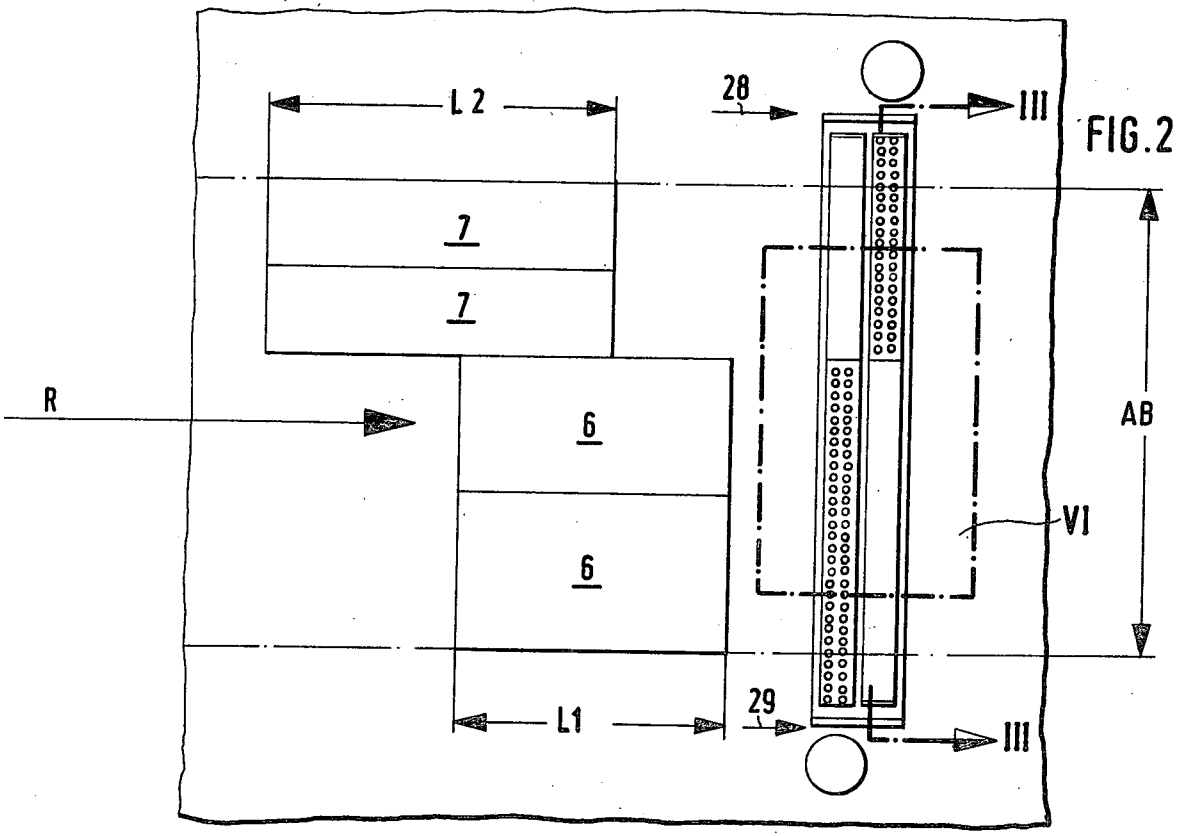
FIG. 2 is a top plan view of the suction braking apparatus.

As may be seen from the top plan view of FIG. 2, the duplex crosscutter 1 cuts first sheets 6 of length $L_1$ and second sheets 7 of length $L_2$. The lengths $L_1$ and $L_2$ may differ from each other. Because of their different lengths, the sheets 6 and 7 must be decelerated by the suction braking apparatus 3 at different times. The direction of travel of the sheets 6 and 7 is indicated by the arrow R.

Figure 3:
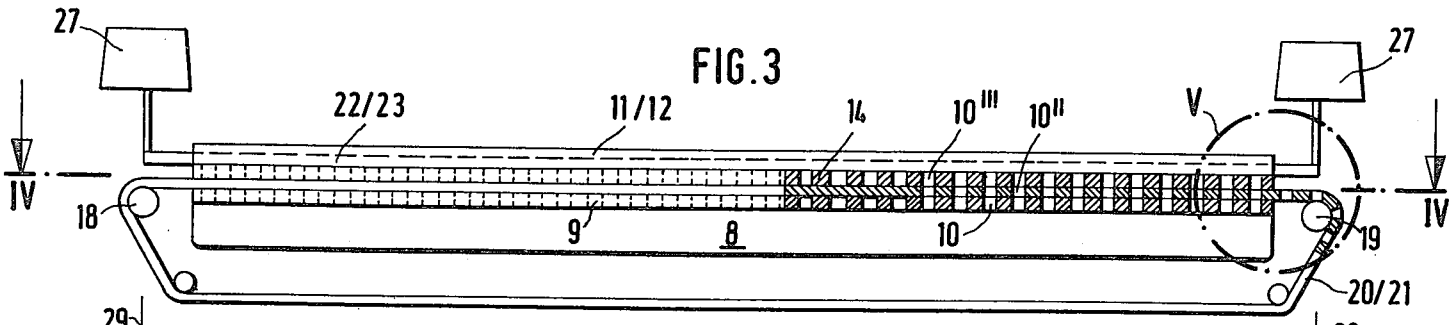
FIG. 3 is a cross-sectional view, taken along the line III—III in FIG. 2, on an enlarged scale.
Figure 4:
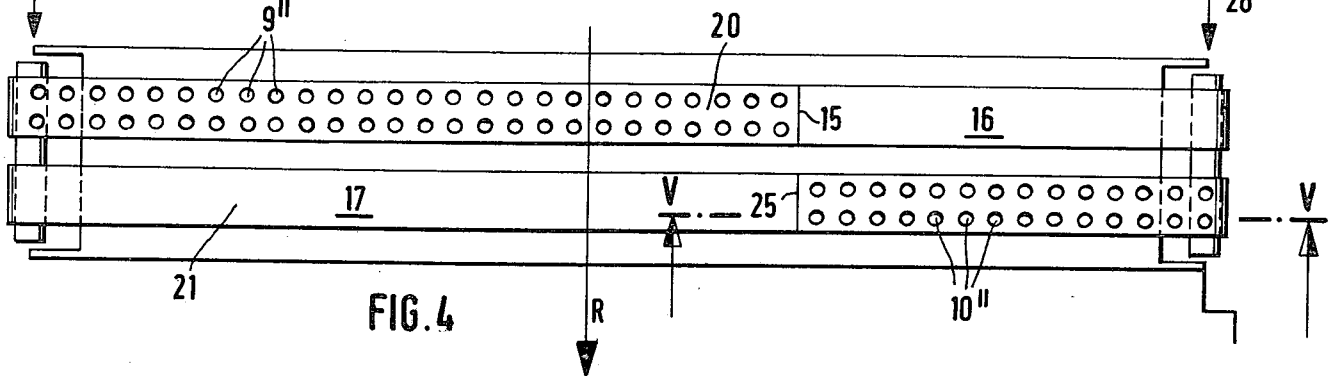
FIG. 4 is a top plan view taken along the line IV—IV in FIG. 3.
Figure 5:
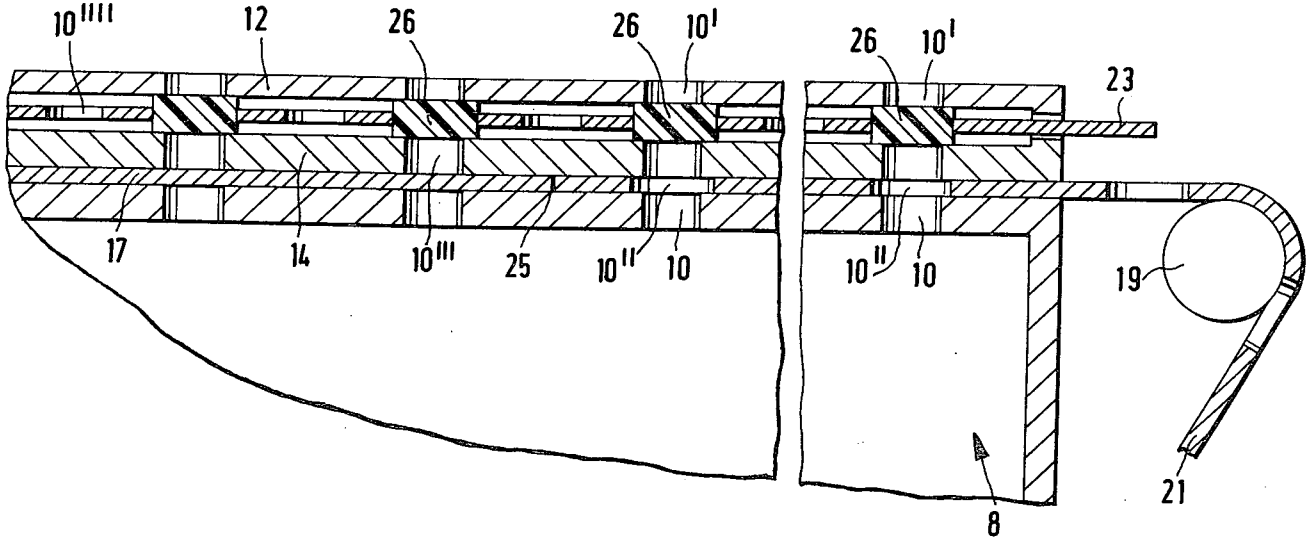
FIG. 5 is a cross-sectional view, taken along the line V—V in FIG. 4, on an enlarged scale.
Figure 6:
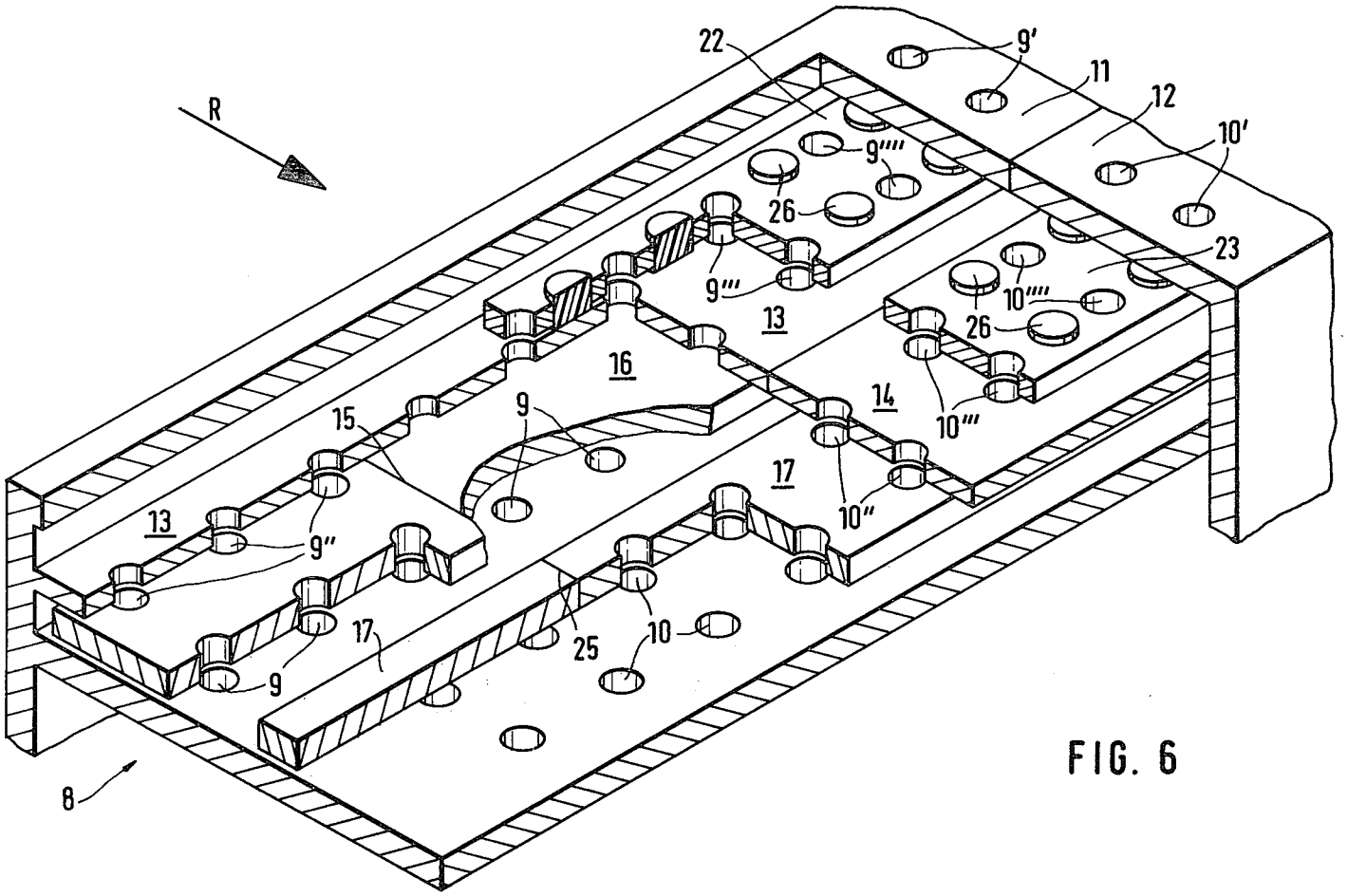
FIG. 6 is a perspective view of the construction according to section VI in FIG. 2.

As is apparent from FIGS. 1 to 3, the suction braking apparatus 3 comprises a single-compartment suction chamber 8 over whose suction area two groups of suction holes 9 and 10 extend. Viewed in the direction of travel R of the sheets, the first group of suction holes 9 extends over the entire width of the suction chamber while the second group of suction holes 10 extends only over half the width of the suction chamber 8. As may be seen particularly from the cross sections of FIGS. 3 and 5, there are disposed above the suction chamber 8, and spaced from the suction surface, a first intermediate plate 13 and a second intermediate plate 14, and above them and spaced from the intermediate plates 13 and 14, a first cover plate 11 and a second cover plate 12. The first and second cover plates 11 and 12 and the first and second intermediate plates 13 and 14 are disposed in a row in the direction of travel R of the sheets so that in cross section only one cover plate and one intermediate plate 14 are visible at a time. The first cover plate is provided with suction holes 9', and the second cover plate with suction holes 10', in register with the suction holes 9 and 10 of the suction chamber. Similarly, the first intermediate plate has registering suction holes 9''', and the second intermediate plate registering suction holes 10'''. In the space between the intermediate plates 13 and 14 and the suction holes 9 and 10 of the suction chamber 8, there is provided for the first group of suction holes 9 a first cover slide 16 movable at right angles to the direction of travel R, and for the second group of suction holes 10 a second cover plate 17 movable at right angles to the direction of travel. In the embodiment illustrated, the cover slides 16 and 17 form part of a first endless belt 20 and of a second endless belt 21, respectively, which pass around the end rollers 18 and 19. For formation of the cover slides 16 and 17, the endless belts 20 and 21 are provided with an unperforated portion and with a portion provided with suction holes 9'' and 10'', respectively. The first cover slide 16 extends from the side 28 as far as the junction 15, and the second cover slide 17 from the other side 29 as far as the junction 25. The junctions 15 and 25 are disposed in a row, viewed in the direction of travel, so that functionally they form a single junction since the suction exerted by the suction chamber 8 can be effective only on one side of the junctions 15 or 25 at a time. Since a portion of the perforations 9 is covered by the first cover slide 16 and a portion of the perforations 10 by the second cover slide 17, there can be no suction in the covered portions. The suction of the first group of suction holes 9 can become effective only on the other side of the junction 15, in the area of the first endless belt in which the suction holes 9'' are disposed. Similarly, the suction exerted through the second group of suction holes 10 can become effective only in the portion of the second endless belt 21 in which the suction holes 10'' are located.

The first control belt 22 extends in the space between the first intermediate plate 13 and the first cover plate 11, and the second control belt 23 in the space between the second intermediate plate 14 and the second cover plate 12. The design and principle of operation of such a control belt have become part of the prior art through German Pat. Nos. 1,917,616 and 2,000,078. The control belts 22 and 23 are adapted to be moved by driving means 27 such as electromagnets at right angles to the direction of travel R of the sheets. Each of the control belts 22 and 23 comprises slide members 26 and suction holes 9'''' and 10'''', respectively. The slide members 26 assure a constant position in the vertical direction and smooth sliding movement while the suction holes 9'''' and 10'''', respectively, uncover the corresponding suction holes in the intermediate plate 13 or 14, respectively, beneath them and in the cover plate 11 or 12, respectively, above them, thus permitting suction to be exerted. The motions of the two control belts 22 and 23 are controlled individually as a function of the sequence of the sheets 6 and 7.

The principle of operation of the apparatus is as follows:

Before the suction braking apparatus 3 is placed into operation, the cover slides 16 and 17 are displaced at right angles to the direction of travel R of the sheets 6 and 7, as a function of the width of said sheets, to the point where the junctions 15 and 25 jointly are aligned with the junction between the sheets 6 and 7, which are of different lengths. This merely calls for the endless belts 20 and 21 to be displaced in the belt direction. In the embodiment illustrated, the first cover slide 16, starting from the side 28, covers about one-third of the first group of suction holes 9 of the suction chamber 8. Of the second group of suction holes 10 of the suction chamber 8, which extend only over half the width of the suction chamber 8, the second cover slide 17, starting from the side 29, covers two-thirds of the width of the suction box, the one-third in which the second group of suction holes 10 is located remaining uncovered. The cover slides 16 and 17 thus reciprocally cover the suction-hole groups 9 and 10, the junctions 15 and 25 being aligned in the direction of travel R of the sheets.

The wider and shorter sheets 6 coming from the crosscutter are decelerated by the uncovering of the first group of suction holes 9 while the narrower and longer sheets 7 are slowed down by the second group of suction holes 10. The suction is exerted on both by the single-compartment suction chamber 8, with the associated control belts 22 and 23, respectively, establishing communication between the suction holes 9''' and 10''', respectively, in the intermediate plates 13 and 14, respectively, and the suction holes 9' and 10', respectively, in the cover plates 11 and 12, respectively, upon the passing of the rear portion of the sheets 6 and 7, respectively.

A changeover to another width of the sheets 6 and 7 merely calls for a transverse displacement of the junctions 15 and 25, that is to say, a transverse displacement of the cover slides 16 and 17, effected through movement of the endless belts 20 and 21.

It will be appreciated that the instant specification and claims are set forth by way of illustration and not limitation and that various modifications may be made without departing from the spirit and scope of the present invention.

What is claimed is:

1. A suction braking apparatus for the braking and overlapping of sheets travelling longitudinally thereover, comprising a suction chamber extending transversely of the direction of travel of the sheets and provided with first and second groups of suction holes, each group extending across a portion of the transverse length of the suction chamber, aligned first and second cover plates respectively provided with perforations in register with the first and second groups of suction holes, first and second cover slides respectively provided for cooperation with the first and second groups of suction holes, the first cover slide ending at a junction line across the suction chamber and transverse of the direction of travel of the sheets where the second cover slide begins, and perforated control belts operatively connected with said first and second cover slides so as to be able to displace them across the suction chamber and thereby locate said junction line at any predetermined point across the suction chamber, whereby the cover slides can be moved to accommodate changes in the width of sheets to be operated upon by each of the first and second groups of suction holes.

2. A suction braking apparatus according to claim 1, including first and second intermediate plates each with holes respectively in registry with the first and second groups of suction holes, the intermediate plates being located above the cover slides and below the perforated control belts.

3. A suction braking apparatus according to claim 2, wherein one of the groups of suction holes extends over the entire width of the suction chamber and the other group of suction holes extends over not more than half the width of the suction chamber.

4. A suction braking apparatus according to claim 3, wherein each of the cover slides is part of an endless band capable of being displaced across the suction chamber by the perforated control belts, the first band being perforated to the left of the junction line and being free of perforations to the right of the junction line while the second band is perforated to the right of the junction line and being free of perforations to the left of the junction line.

* * * * *